US005934039A

United States Patent [19]

Guy

[11] Patent Number: 5,934,039

[45] Date of Patent: Aug. 10, 1999

[54] APPARATUS AND METHOD FOR DIMENSIONALLY UNIFORM BUILDING CONSTRUCTION USING INTERLOCKING CONNECTORS

[76] Inventor: John H. Guy, Rua Bariloche #226 Cavaleiros, Macaé, R J., Brazil, CEP 27920-160

[21] Appl. No.: 08/992,664

[22] Filed: Dec. 17, 1997

Related U.S. Application Data

[62] Division of application No. 08/815,327, Mar. 10, 1997.

[51] Int. Cl.[6] ..... E04B 2/00

[52] U.S. Cl. ..... 52/747.12; 52/745.1; 52/745.13; 52/745.16; 52/604; 52/564; 52/561; 52/586.2; 52/585.1; 52/590.1

[58] Field of Search ..... 52/604, 605, 606, 52/607, 561, 562, 564, 565, 568, 569, 570, 571, 582.1, 586.1, 586.2, 585.1, 575, 102, 481.1, 481.2, 483.1, 489.1, 489.2, 731.5, 731.4, 733.2, 590.1, 589.1, 592.1, 592.4, 781.5, 745.05, 745.1, 745.13, 745.16, 747.12; 47/33; 403/DIG. 10, 381

[56] References Cited

U.S. PATENT DOCUMENTS

| | | | |
|---|---|---|---|
| 794,595 | 7/1905 | Ducker | 52/92.2 |
| 950,140 | 2/1910 | Lucke | 52/607 X |
| 1,985,992 | 1/1935 | Hayman | 52/241 |
| 2,368,523 | 1/1945 | Cowbourne | 52/293.1 |
| 3,076,286 | 2/1963 | Czecholinski | 52/480 X |
| 3,305,982 | 2/1967 | Steele | 52/90.1 |
| 4,019,298 | 4/1977 | Johnson, IV | 52/590.1 |
| 4,597,236 | 7/1986 | Braxton | 52/564 |
| 4,894,963 | 1/1990 | Campbell | 52/92.3 |
| 5,170,600 | 12/1992 | Terrell | 52/91.1 |

FOREIGN PATENT DOCUMENTS

| | | | |
|---|---|---|---|
| 484750 | 5/1938 | United Kingdom | 52/586.2 |

*Primary Examiner*—Carl D. Friedman
*Assistant Examiner*—Laura A. Callo
*Attorney, Agent, or Firm*—Jesse D. Lambert

[57] ABSTRACT

Apparatus and method for dimensionally uniform building construction using interlocking connectors. In the preferred embodiment, the apparatus comprises a system of building blocks, each block having a top, a bottom, an interior face, an exterior face, and two end faces. Each block is substantially dimensionally uniform, and has at least one vertically aligned female dovetail slot in each face, with substantially uniform lateral spacing between slots. Interlocking connectors or clips, in one embodiment comprising dual male dovetails, mate with the female dovetail slots and connect the blocks together. After erection of the wall, reinforcing rods and concrete may be placed within the block cavities. In similar fashion, objects such as exterior facing and interior cabinetry may be suspended from the faces of the blocks by attaching clips to the objects then inserting the clips in the mating female dovetail slots. The invention further comprises generally vertically disposed wall studs having female dovetail slots therein. By affixing clips to desired wall hangings, the hangings can then be suspended from the wall studs. Another embodiment of the clip provides a stop screw therein for fixed placement of the clip at a desired elevation. With such clip in place, other objects may then be placed at a desired elevation by using the screw-containing clip as a stop. Structural members such as ceiling joists and roof rafters may be attached to walls constructed from the building blocks, by clips fastened to the center joists or roof rafters then inserted into the dovetail slots.

1 Claim, 11 Drawing Sheets

FIG. 1(a)
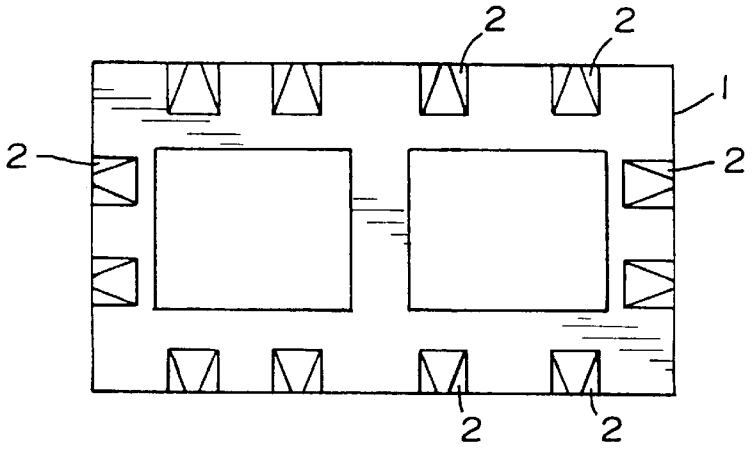
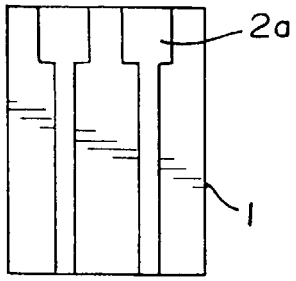
FIG. 1(b)
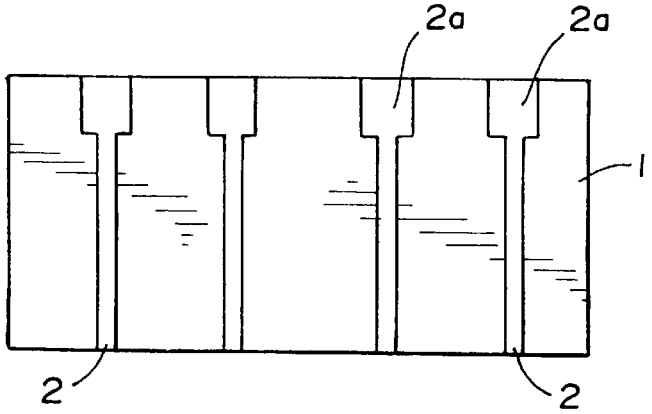
FIG. 1(c)

FIG. 1(d)
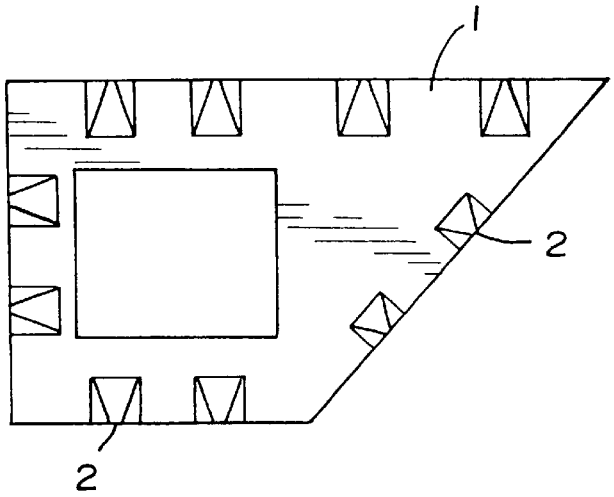
FIG. 1(e)
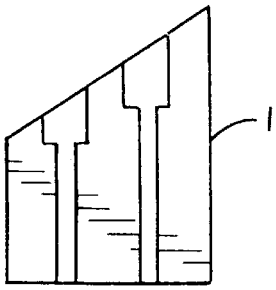
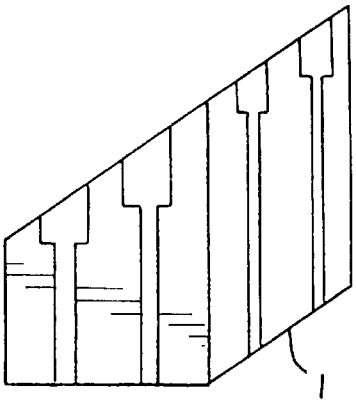
FIG. 1(f)

FIG. 2(g)
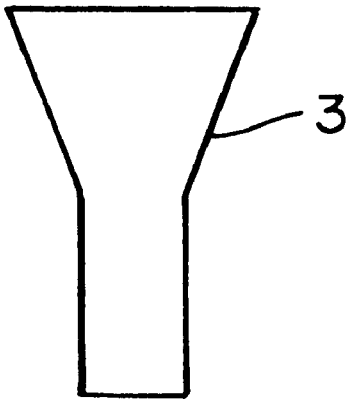
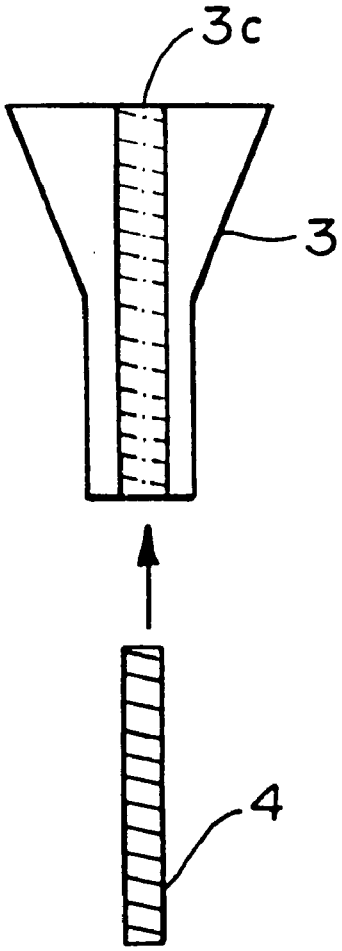
FIG. 2(h)

FIG. 5(a)
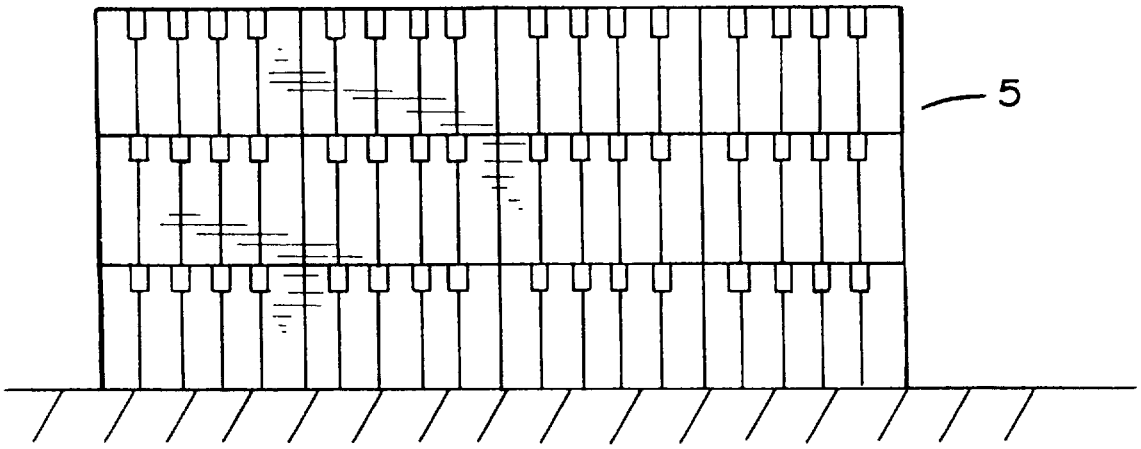
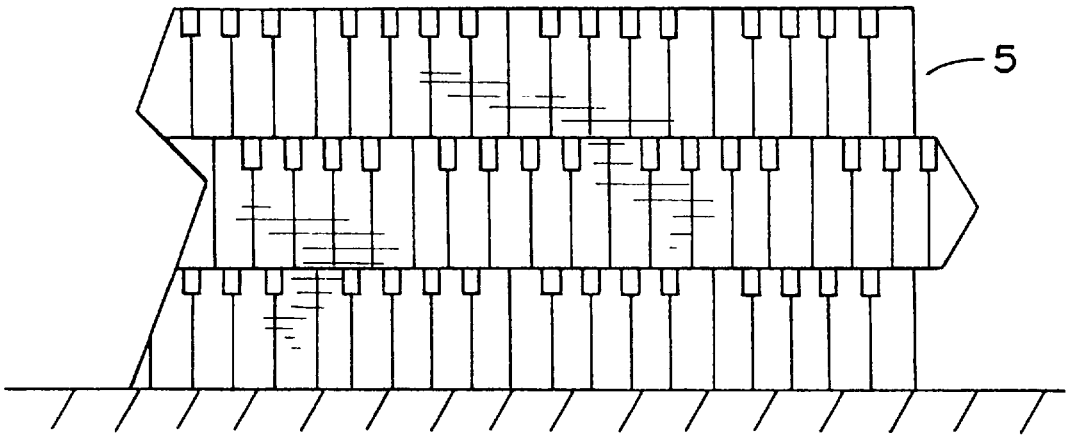
FIG. 5(b)

APPARATUS AND METHOD FOR DIMENSIONALLY UNIFORM BUILDING CONSTRUCTION USING INTERLOCKING CONNECTORS

This application is a division of application Ser. No. 08/815,327, filed Mar. 10, 1997, status pending.

BACKGROUND

1. Field of the Invention

This invention relates to an improved apparatus and method for construction of commercial and residential buildings and other structures. More specifically, this invention relates to improved building components and interlocking connectors and method of dimensionally uniform building, and other structure, construction using the components.

2. Description of Related Art

Construction of commercial and residential buildings has long been done using various types of building components, including for example building blocks for walls and wooden wall stud members and wooden rafters for interior walls, ceilings and roofs. These different components are usually connected with conventional nails, screws, adhesives and the like. For purposes of this patent application, the term "building block" is understood to encompass those building components commonly referred to as "bricks" and those commonly referred to as "concrete building blocks" and "cinder blocks". Building block construction for walls, both exterior and interior, has the advantages of being relatively maintenance free, durable, and cost effective.

Although always necessarily interconnected, building construction may be viewed as addressing two primary facets: one being construction of the walls (both interior and exterior) including such elements as windows and doors in the walls; and the second being construction of the remaining parts of the building, including the ceiling and roof.

Wall Construction

One conventional method of building wall construction has been to construct an interior wall and exterior wall framework using metal or wood structural members, and thereafter placing a brick veneer on the exterior walls of the building and some form of panelling on the interior walls. In this building method, the brick veneer is non-load bearing but serves to protect the structural members from the elements (such as rain) as well as provide a desired external appearance.

Another method of wall construction has been to use the building blocks as the load bearing members. This method has often been employed in commercial construction and perhaps to a lesser degree in construction of residential homes. Conventional methods of building wall construction using building blocks utilize concrete building blocks having cavities therein (the building blocks typically having at least two cavities spanning the entire height of the building block), and mortar to bind the blocks together. To adhere the blocks together on a more permanent basis and for added strength, concrete may be poured into the building block cavities, and reinforcing rods (usually made of iron) may be placed within the block cavities for yet additional strength.

However, a number of disadvantages accompany these conventional wall construction methods. In both brick veneer and building block construction, the conventional mortar construction technique requires typically expensive, skilled bricklayers to form building block walls. Additionally, since such blocks and the thickness of mortar between the blocks vary in dimensions, two walls constructed with an equal number of blocks may not have equal dimensions, both in length and height. Such differences are typically accounted for by use of partial blocks placed somewhere in the wall structure, usually at the ends of walls, the partial blocks requiring individualized measuring and cutting to fit. Such individualized, custom cutting to fit is relatively expensive to implement, but is necessary as the walls will not fit properly together without the individualized modifications.

In addition to certain disadvantages and difficulties arising in conventional construction of building block walls, other problems arise in attempting to fasten or suspend objects from such walls. A number of different functional and cosmetic objects may be desired to be suspended from building block walls. For example, on the exterior face of the blocks, standard bricks, typically having dimensions of approximately 3" wide, 6" long, and 3" high, may be used. Another possible exterior facing yields the appearance of conventional brick; here, the facing consists of relatively thin (on the order of ¼" thick) "bricks", which essentially comprise the faces of conventional bricks. Other possible exterior materials include wood, metal, or vinyl siding. Furthermore, the use of concrete building blocks in lieu of walls constructed with wooden studs will yield a superior structure, being stronger and resistant or impervious to fire, decay, and wood-destroying insects such as termites.

It is also desired to suspend objects from the interior faces of the building blocks, which comprise the interior walls of the building. By way of example, "sheetrock" may be desired to be suspended from interior walls to provide a smooth, uniform surface for painting, wall paper and the like. Items such as wood panelling, paintings, mirrors, photographs and the like may be hung from the walls. Functional items such as cabinetry may be needed to be installed in different parts of the building, particularly in residential applications. In addition, tile for bathroom, kitchen, workrooms, and the like may be hung from the building block walls. To suspend objects from either the exterior or interior wall faces, preferably provisions are made both in the structure of the building blocks and in providing an interlocking connector or clip means which cooperatively engages both the building block and the object to be suspended.

While earlier patents disclose various types of building blocks and methods of wall construction using interlocking blocks, locking members to hold blocks together and the like, the related art does not disclose a system of building construction using comprising blocks which are substantially dimensionally uniform, which are capable of connection to one another without mortar if desired so as to form a wall or wall section, and which have provision for suspending objects from the interior and exterior faces of the blocks.

Construction of Other Parts of Buildings

In addition to interior and exterior walls made of building blocks, interior walls are often made of wooden studs, typically of dimensional lumber nominally 2" by 4" in cross section. To place sheetrock on such walls, the sheetrock must be nailed or screwed to the wooden studs. This is relatively time consuming and requires relatively expensive, skilled labor to perform. Preferably, sheetrock or any other wall coverings could be suspended from (usually) vertically-running stud members, without nails or screws, by providing clip means for cooperatively engaging appropriate cavities in the studs, the means also connected to the sheetrock or other materials. By such means, the sheetrock could be merely "hung" on the studs, and interior wall sections formed very simply and quickly.

Yet other aspects of building construction wherein walls are constructed with wooden studs require substantial amounts of time and skilled labor. For example, "openings" such as are required for windows and doors must be incorporated into building block walls. Some sort of framework must surround such openings, to provide support for the surrounding building block wall and to provide mounting means for windows and doors contained within the wall openings. In typical construction, the framework must be built up out of dimensional lumber, cut to fit the opening. Other structural members require specialized, custom fitting; some of these are rafters (being the members which rest on the building block wall and form typically peaked roofs and support the roof) and ceiling joists (which provide both structural support and a means for suspending ceiling coverings, such as ceiling tiles and the like). Preferably, such members would be made so as to connect to the building block walls with few conventional fasteners required; instead, by connecting to the walls by connecting means engaging the cooperative cavities or slots in the building blocks.

Construction of Other Structures

In addition to the construction of residential and commercial buildings, other types of structures lend themselves to construction using building blocks and related connectors. For example, it is often desired to construct outdoor, free-standing walls, for such applications as recreational tennis courts and the like. Bridges spanning rivers, valleys, and other obstacles may be constructed wholly or in part with building blocks.

Walkways and outdoor retaining walls for gardens and flower beds may also be constructed with building blocks and related components, in particular certain embodiments of the building blocks known as "paving stones". In short, any structures that lend themselves to construction using building blocks may be constructed using the building blocks, related components, and method of the present invention.

Objects and Advantages

Accordingly, in addition to the objects and advantages of the building block and connecting means described above, several objects and advantages of the present invention are:

(a) to provide an improved, substantially dimensionally uniform, building block design and means for connecting said building blocks to one another, which permits construction of building block walls without the necessity of mortar between the blocks, and that minimizes or eliminates the need for cutting of partial building blocks in order to yield a wall section having a desired dimension;

(b) to provide an improved building block design and connecting means that permits objects to be suspended from the interior and exterior faces of the building block at desired locations on the wall, with minimal need for conventional fasteners such as nails, screws, and adhesives;

(c) to provide a means for installation of roof rafters, ceiling joists, and framing members for windows, doors and the like, that utilizes connecting means engaging the building blocks and avoids or minimizes conventional fasteners for attaching the rafters and joists to the building blocks, and for forming the framings;

(d) to provide a means for forming interior walls by suspending "sheetrock" or other like materials from wall studs, by providing appropriate cavities within the wall studs and connecting means to engage both the wall stud cavity and the sheetrock and permit "hanging" the sheetrock without conventional fasteners;

(e) to provide apparatus and method for building construction which minimizes excess materials and the resulting waste requiring disposal; and (f) to provide apparatus and method for the uniform, simplified construction of other structures, including but not limited to buildings, floor surfaces for multi-story buildings, free-standing walls, bridges, outside structures such as steps, retaining walls for flower beds, paving stones for firm paved surfaces, and the like.

Still other objects include an apparatus and method for building construction which may be readily carried out by relatively unskilled workers in rapid fashion. Still further objects and advantages will become apparent from a consideration of the ensuing description and drawings.

SUMMMARY OF THE INVENTION

The present invention comprises an apparatus and method for constructing external and internal building walls, for suspending objects from the walls, for connecting structural members to each other and to building walls, and for constructing various other structures such as free-standing walls, bridges, walkways, retaining walls for flower beds, and the like. In the preferred embodiment, the apparatus comprises a system of building blocks, each block having a top, bottom, and four faces (interior, exterior, and two ends). In the preferred embodiment, each face has at least one vertically aligned female dovetail slots therein, with lateral spacing between slots uniform. The blocks may have substantially uniform overall dimensions to permit uniform room dimensions, both wall length and height, when walls are constructed with the blocks. Interlocking connectors, hereinafter referred to as clips, comprising preferably two connected male dovetails cooperatively engage the female dovetail slots in either end of the blocks and connect the blocks together end-to-end. Vertically engaged blocks may be connected in similar fashion when slots on vertically adjacent blocks are aligned, and clips may be inserted to span the joint between the vertically adjacent blocks. In similar fashion, objects such as exterior facing and interior cabinetry may be suspended from the external and internal faces of the blocks using clips comprising at least one male dovetail to connect the objects to the blocks using the dovetail slots in the interior and exterior faces of the blocks. After walls are erected using the blocks, reinforcing rods and concrete may be placed within the block cavities for added strength, and post-construction stresses may be imposed on the wall sections to further increase strength and rigidity. Other building components, such as roof rafters, ceiling joists, and wall studs, may be connected to the building blocks and to each other by insertion of clips in aligned female dovetail slots, and these additional building components may comprise female dovetail slots which permit suspension of objects from the components by use of the clips. In addition, the clip and certain embodiments of the building block may be used to form solid ceilings or multi-story buildings, by using the clip of the present invention to connect tiles to ceiling joists forming a surface upon which concrete may be poured (by way of example, to a depth of one to four inches) to create a solid floor. Other embodiments of the building blocks may comprise blocks having at least one face without any slot therein, and blocks having end faces which intersect the side faces at an oblique angle; such blocks permit construction of building walls forming curves. Still another embodiment comprises building blocks in which the upper face intersects the side faces at an oblique angle, for simplified construction of stairways and wall sections intersecting roof rafters. Yet another embodiment comprises paving stones, which are typically relatively thin (on the order of one to three inches thick) stones with square, rectangular, octagon or other shapes, which may be laid on earthen surfaces and connected with the clip of the present invention to provide a firm surface for foot and vehicle traffic, while at the same time presenting a pleasing appearance.

DRAWING FIGURES

FIG. 1(*a*) through 1(*c*) are top, side, and front view schematics of one embodiment of the building block of the present invention. FIG. 1(*d*) through 1(*f*) are schematics of another embodiment of the building block of the present invention.

FIG. 2(*a*) through 2(*h*) are schematics of different embodiments of the interconnecting clip of the present invention.

Figure 7A:
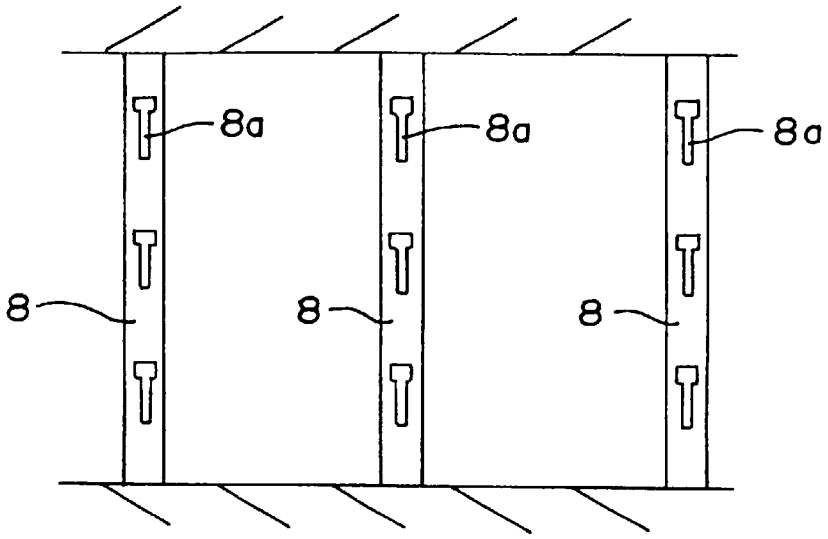
Figure 7B:
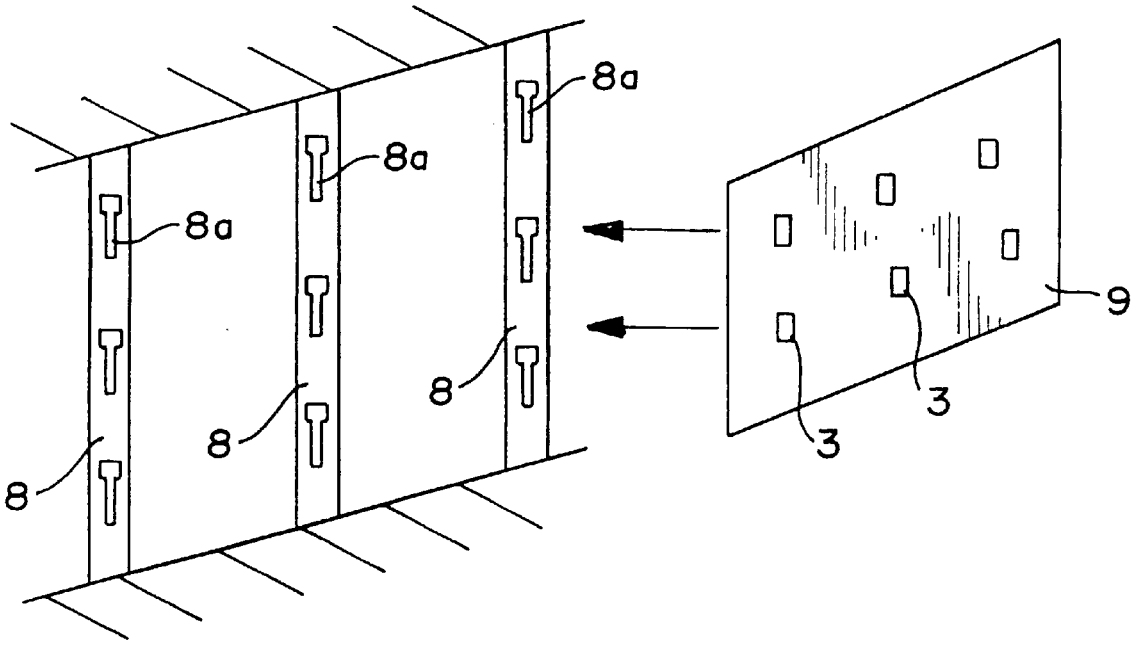

FIGS. 7(*a*) and 7(*b*) are schematics of wall studs having female dovetail slots for receiving the clips of the present invention, and a wall hanging of "sheetrock" positioned for mounting thereon.

Figure 8A:
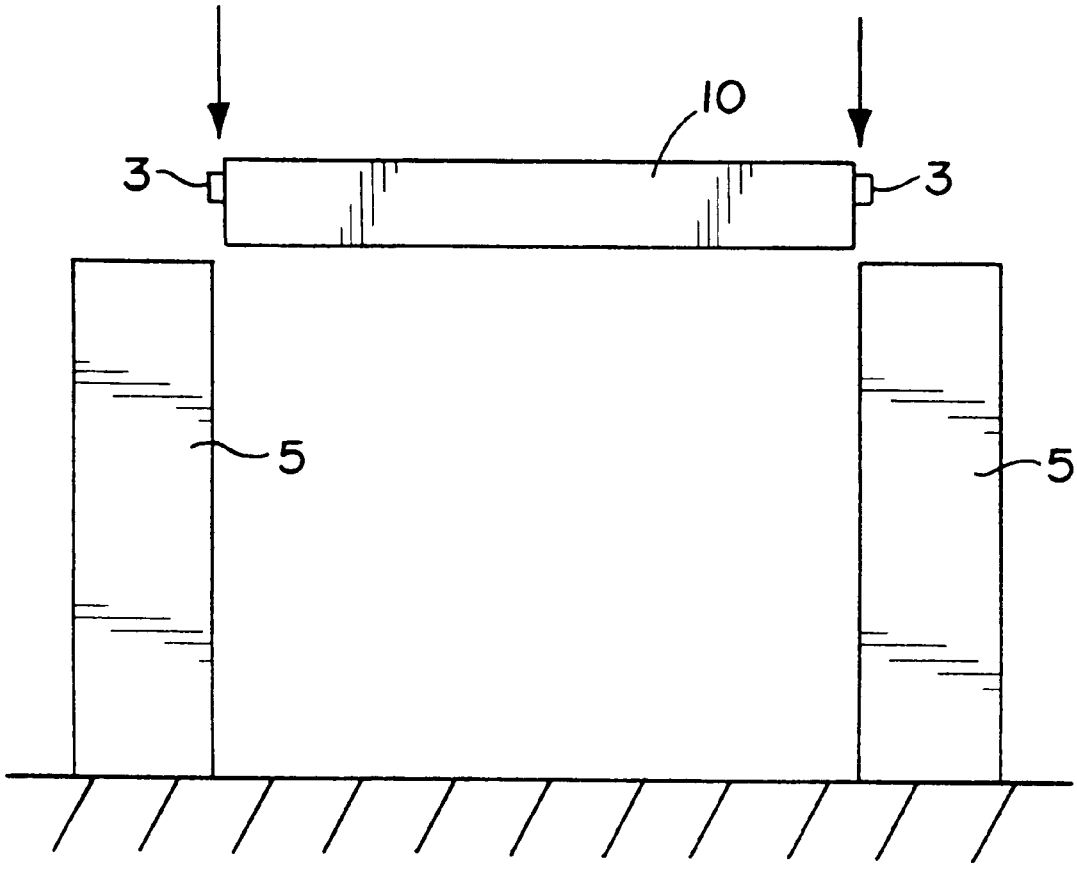
Figure 8B:
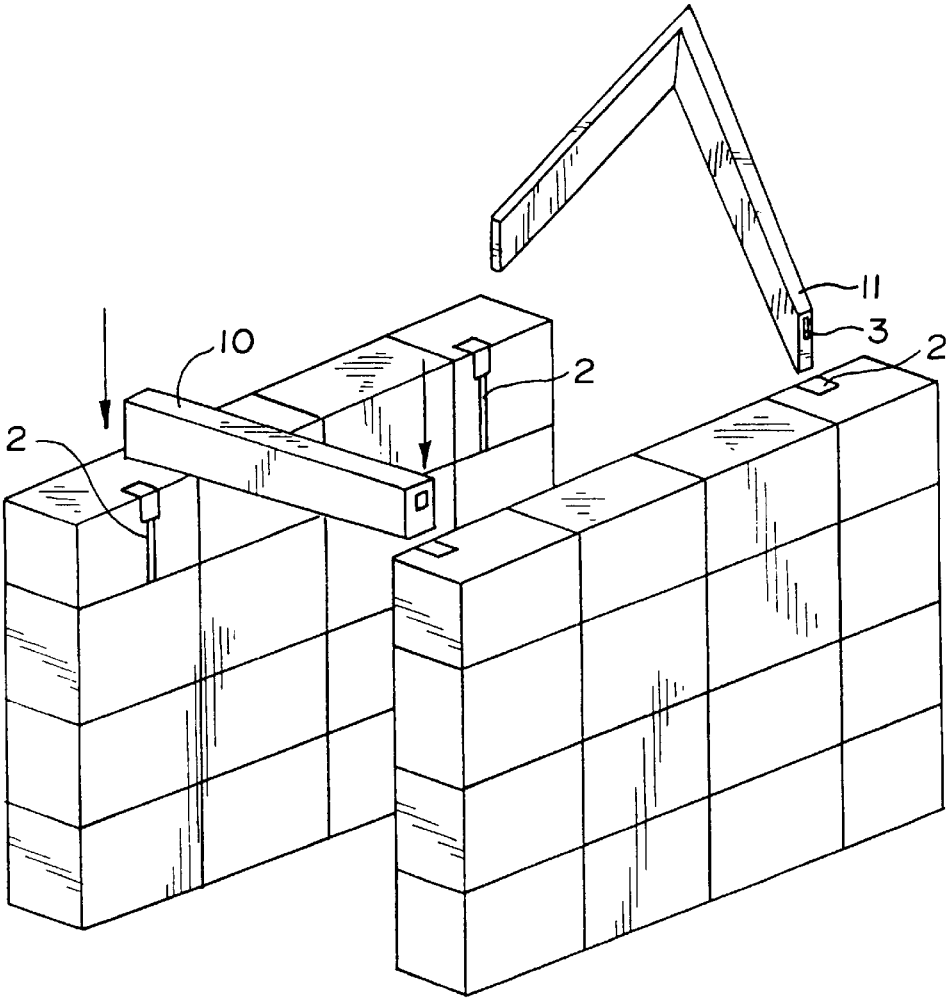

FIGS. 8(*a*) and 8(*b*) are schematics of a ceiling joist and a roof rafter mounted to a building block wall using the clip of the present invention.

Figure 9:
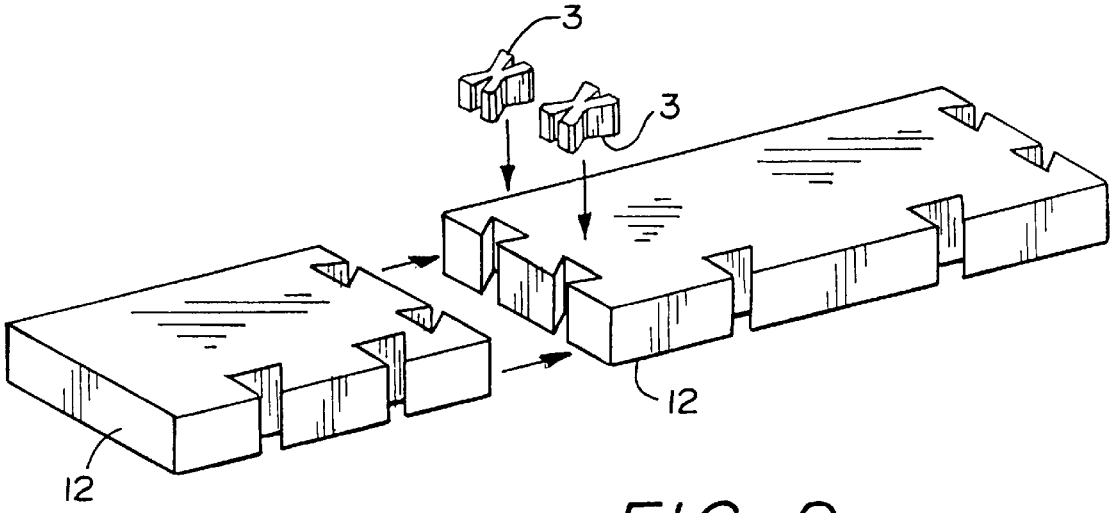

FIG. 9 is a schematic of interconnecting paving stones comprising the slot and the clip of the present invention.

DESCRIPTION —FIG. 1 through 5

With reference to FIG. 1 through 5, one embodiment of the present invention, in particular the building block and clip, is now described.

As shown in FIG. 1(*a*) through 1(*c*), building block 1 has top and bottom surfaces, an interior face, an exterior face, and two end faces. Building block 1, in the preferred embodiment, further comprises a plurality of generally vertically disposed female dovetail slots 2 in each block face. While FIG. 1(*a*) through 1(*c*) show four female dovetail slots in each of the interior and exterior block faces (the long sides of the blocks) and two slots in each end face (the short sides of the block), it is understood that different numbers of slots, either greater or lesser, could be employed. It is further understood that at least one face of the block may have no slots. While in this embodiment slots 2 extend the entire vertical dimension of the building block, it is understood that in alternative embodiments slots 2 may extend from the upper edge of building block 1 to a distance partially down the vertical dimension of building block 1. The cross-sectional shape of the slots, as seen in FIG. 1(*a*), is that shape commonly referred to as a "dovetail", with the slot width at the surface of the block less than the slot width distal from the surface of the building block. At some location along slot 2, typically at the upper end of slot 2, an expanded clip entrance area 2*a*, best shown in FIGS. 1(*b*) and 1(*c*), permits the clip of the present invention, which as hereinafter described has at least one male dovetail portion, to be inserted into slot 2 (to be then slid into a portion of the slot which will provide an interference fit). FIG. 1(*a*) is a top view schematic of the profile of the female dovetail slot, representing one embodiment of the female dovetail profile shape. It is understood that other dovetail profiles could be employed to suit particular applications. In the preferred embodiment, slots 2 are all at a uniform spacing from one another on the faces of each block. This permits easy installation of interior and exterior wall hangings, facings, cabinetry, etc. as clips may be installed at known spacings on the wall hangings to engage the female dovetail slots, as will be hereinafter described.

Building block 1 is preferably formed from a concrete slurry by a molding process which incorporates slots 2 in the block when manufactured. However, it is understood that the block material may be varied, for example, by using clay materials typically used for conventional "bricks", and the method of forming the slots may be varied, as by first forming the block then cutting the slots therein.

Also, although building block 1 is shown as having two cavities therein, each rectangular in cross-section, it is understood that the invention is not limited to a block of this configuration, and building block 1 could have no cavities at all or greater than two cavities.

In the preferred embodiment, length, height, and width of all building blocks 1 are substantially dimensionally uniform. This permits the construction of building block walls and other structures having uniform length and height dimensions, when the building blocks are connected without mortar by use of the clip of the present invention. By way of illustration only, building blocks 1 may be $11\frac{15}{16}$" in length, $5\frac{31}{32}$" in width, and 6" in height. Building blocks having these dimensions permit fabrication of walls having dimensions in multiples of 6", for example 10'0", or 10'6", or in multiples of 12". By such substantially dimensionally uniform building blocks, the cutting and fitting of partial building blocks (typically at the ends of wall sections) to achieve opposing wall sections of substantially equal length is minimized.

Other embodiments of building block 1 are shown in FIG. 1(*d*) through 1(*f*). The embodiment shown in FIG. 1(*d*) is a top view schematic of a building block having at least one end face intersecting the side faces at an oblique angle. Typically, at least one slot 2 is provided in the end face, as in the preferred embodiment, to permit connection to the abutting block. The embodiment shown in FIG. 1(*d*), depending upon the angle at which the end face intersects the side faces, permits simplified construction of building wall structures in which it is desired to form other than a straight wall, or a right angle, and permit simplified formation of curved walls. The embodiment shown in FIGS. 1(*e*) and 1 (*f*) (showing end and perspective views, respectively) shows a building block in which the upper surface intersects the side faces at an oblique angle. This embodiment permits simplified construction of structures having an upwardtrending angle, such as stairways (not shown), and for construction of the uppermost surface of building walls on which angled supports (such as roof rafters and the like) rest.

Yet another embodiment of building block 1 (not shown) provides cavities therein for placement of various utilities such as electrical power cables and water pipes, without the necessity for labor-intensive hand chiseling of the blocks to permit running utilities therethrough.

FIG. 2(*a*) through 2(*h*) are schematics showing different views and embodiments of clip 3. Clip 3 may be made of any durable, relatively high strength material, such as metal or high strength plastic. While a particular shape of clip 3 forming a male dovetail is shown, it is understood that clip 3 may have different shapes depending upon the shape of the female dovetail slot in which it is to engage. The common elements of such different shapes, as seen in cross section, are a wider end 3*a* tapering to a narrower "waist" at 3*b*. Clip 3 therefore cooperatively mates with the profile shape of female dovetail slot 2, permitting clip 3 to be inserted into enlarged section 2*a*, then moved into that portion of female dovetail slot 2 which provides an interference fit and prevents clip 3 from being pulled out of female dovetail slot 2. When clip 3 is properly engaged in female dovetail slot 2, a portion of clip 3 distal from the engaged portion typically protrudes from female dovetail slot 2 and from a face of building block 1.

The section of clip 3 distal from female dovetail slot 2 and protruding from building block 1 may take different shapes depending upon the object to which it attaches. The embodiment shown in FIG. 2(*a*) through 2(*c*) (showing top, perspective, and end views) is suited for connecting adjacent building blocks 1. FIG. 2(*d*) through 2(*f*) show perspective, top, and end views of another embodiment of clip 3. FIG. 2(*g*) shows an embodiment of clip 3 which comprises a generally uniformly rectangular in cross section protruding end, which may be attached to wall hangings by various means known in the art, for suspending the wall hangings from a building block wall. FIG. 2(*h*) shows an embodiment of clip 3 comprising a threaded hole through the longitude of clip 3. Screw 4 is of sufficient length to completely penetrate bore 3*c* and contact the innermost wall of female dovetail slot 2. When screw 4 is advanced and contacts the innermost wall of female dovetail slot 2, clip 3 is forced to the tapered faces of female dovetail slot 2, and clip 3 is thus fixed in place. A clip fixed in this manner provides a positive stop for additional clips engaged in female dovetail slot 2, thus permitting wall hangings to be placed at a desired elevation on a building block wall.

Figure 2C:
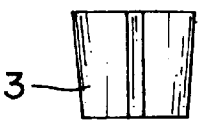
Figure 2A:
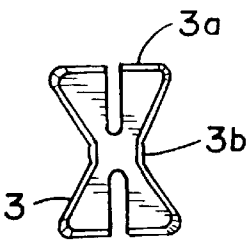
Figure 2B:
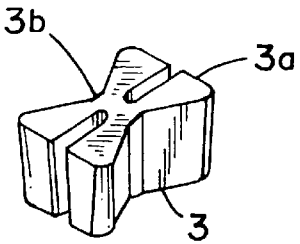
Figure 2F:
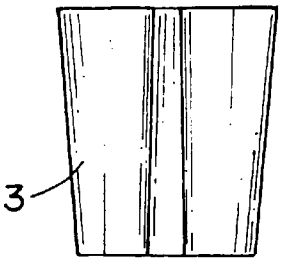
Figure 2E:
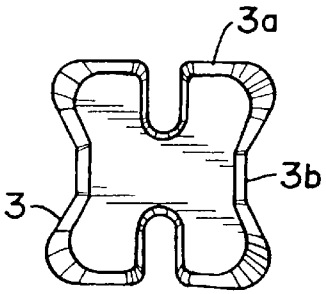
Figure 2D:
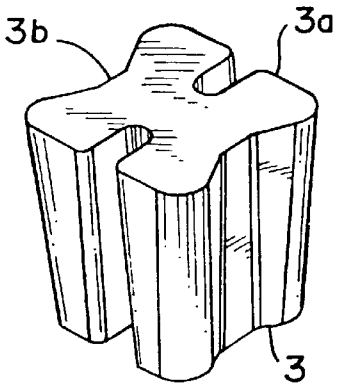
Figure 3:
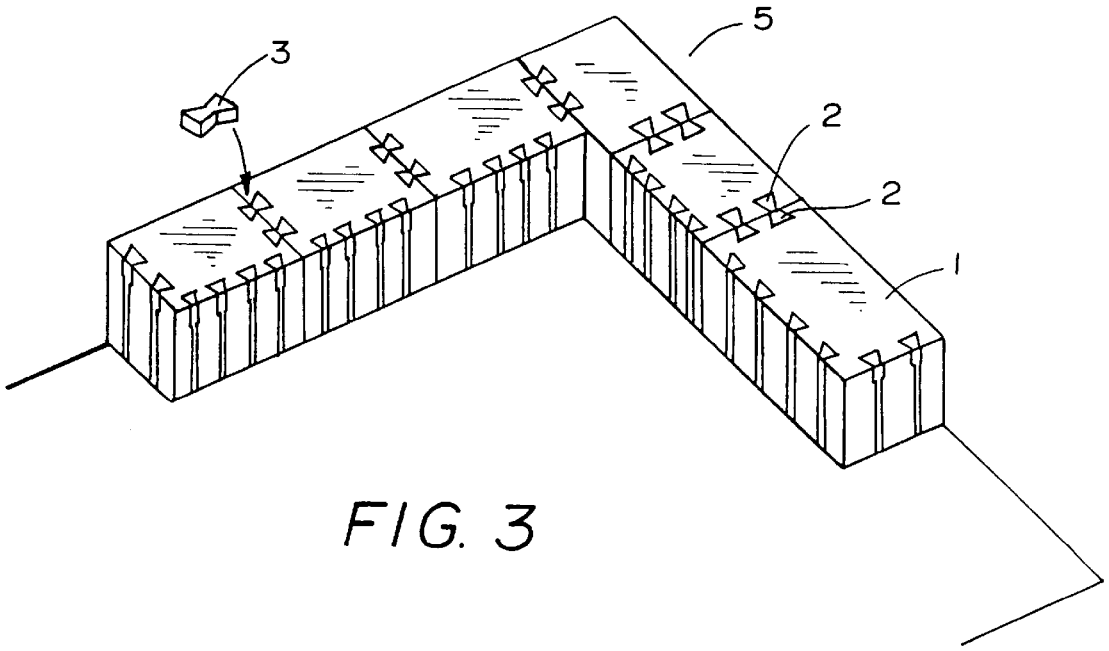
FIG. 3 is a perspective schematic of a wall section formed from building blocks and connectors of the present invention.
Figure 4:
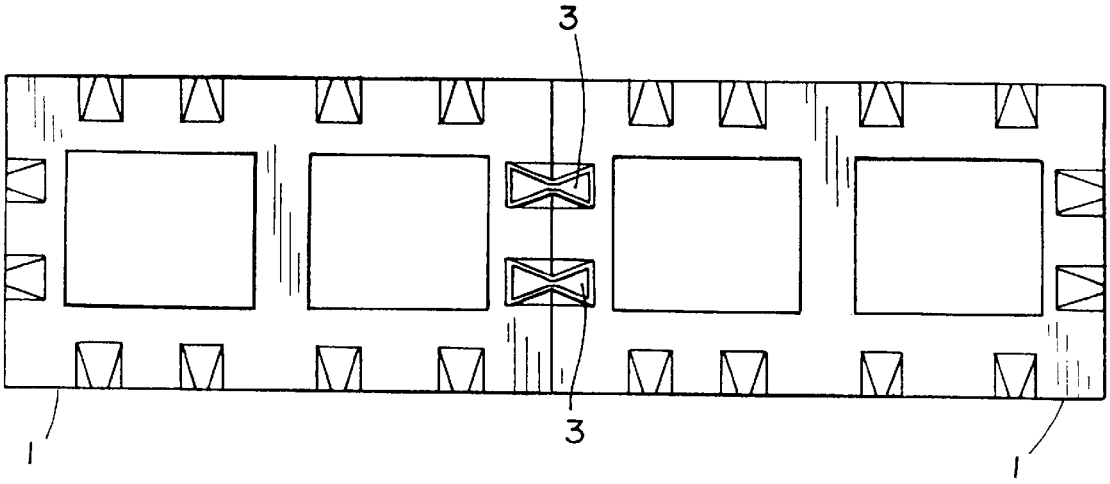
FIG. 4 is a top view schematic of two building blocks connected with the clip of the present invention.
Figure 5C:
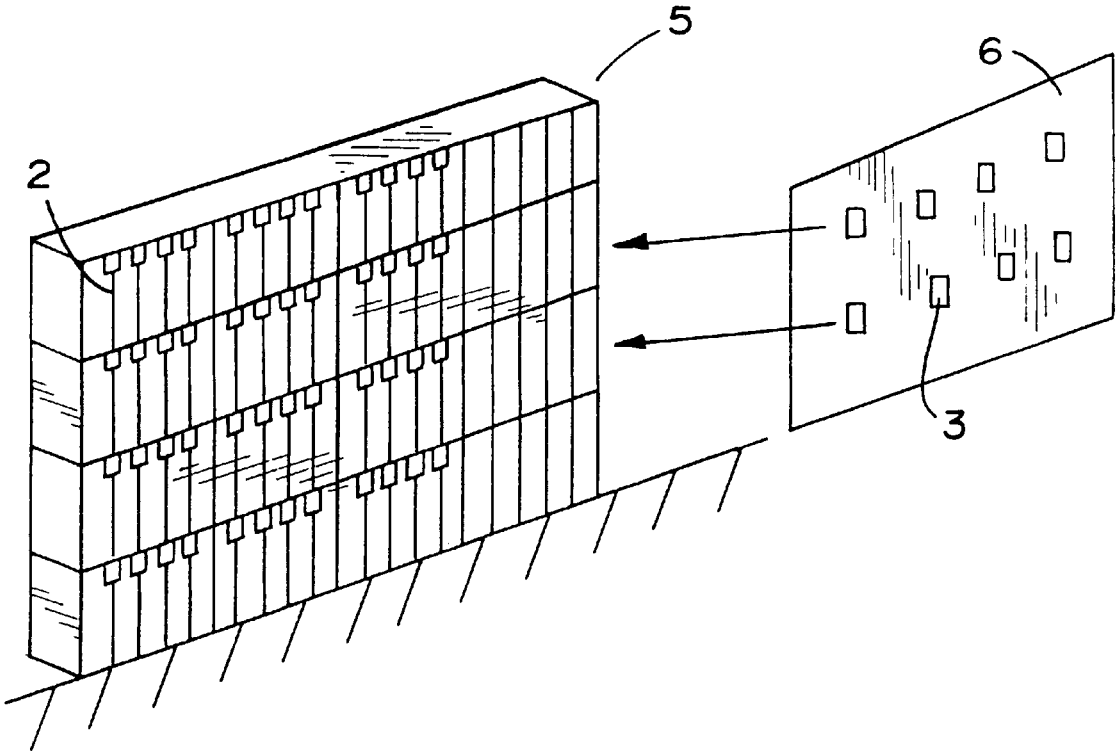
FIG. 5(*a*) through 5(*c*) are schematics of wall sections constructed from building blocks of the present invention, additionally showing installation of a wall hanging thereon.

A method of forming a building wall using the building blocks of the present invention will now be described, using an exterior wall as an example. Although a poured concrete slab is preferably first provided to serve as a base for the walls of the building, other types of firm bases could be employed. As shown in FIG. 3, starting at one corner, a row of building blocks 1 is arranged along an edge of the slab. Each building block 1 is placed abutting the next block, with female dovetail slots 2 in the end faces of adjacent blocks aligned with one another. A clip 3 is inserted into the adjacent female dovetail slots 2 from above, as in FIG. 3, thus locking adjacent building blocks 1 together. In FIG. 3, certain details (such as some of slots 2) are omitted from the drawings of building blocks 1 for clarity. FIG. 4 is a top view schematic showing the interlocking relationship of clips 3 and female dovetail slots 2. In like manner, the initial row of building blocks 1 is completed, and a second row of building blocks 1 is placed atop the first row. Repeating the process until the wall reaches a desired height results in a wall 5, as shown in FIGS. 3, 5(*a*) and 5(*b*). It is understood that different arrangements of blocks can be employed, with the block end edges vertically aligned, or staggered by approximately ½ block length, as in FIGS. 5(*a*) and 5(*b*).

Once wall 5 is constructed, female dovetail slots 2 are exposed on the exterior and interior faces of building blocks 1. It is understood that wall 5 may be an interior wall, in which case two interior faces will exist. Female dovetail slots 2 therefore provide a multitude of receptacles at known locations from which different objects or wall hangings may be suspended. As used herein, "wall hangings" comprise any objects desired to be suspended from a building block wall, such as sheetrock, brick, cabinetry, mirrors, tile, and the like. FIG. 5(*c*) shows wall 5 presenting female dovetail slots 2. It is understood that some details of building block 1 are omitted in FIG. 5(*c*) for overall clarity. Wall hanging 6 has disposed thereon at least one clip 3. Typically, a plurality of clips 3 will be attached to wall hanging 6, at spacings equal to the spacing of female dovetail slots 2. Therefore, wall hanging 6 may be suspended from wall 5 by engaging clips 3 in the enlarged sections 2*a* of mating female dovetail slots 2, then moving wall hanging to a desired elevation. As described above, the embodiment of clip 3 which permits forming a "stop" (as shown in FIG. 2(*d*)) may be employed to fix the elevation of wall hanging 6.

In like manner, a brick veneer (not shown) may be placed over building blocks 1 by affixing clips 3 to each brick face, then suspending the bricks from female dovetail slots 2 in building blocks 1. The brick faces can be arranged so as to be touching one another, or sufficient space may be provided between brick facings such that the appearance of a conventionally mortared brick veneer may be achieved by filling the spaces with mortar or mortar-appearing material.

Interior wall hangings for the building blocks of the present invention include sheetrock or interior paneling, installed as described above. Another important interior application of the invention is the installation of cabinetry. Cabinets often represent a significant weight load when containing various goods, and are difficult to securely install in conventional building block walls. A number of clips 3 may be affixed to the rear of a cabinet, with the location of clips 3 determined by the spacing of female dovetail slots 2. By using a large number of clips 3, the overall weight of the cabinet may be safely distributed across a large wall area.

The building blocks of the present invention provide a simple, versatile, and secure manner to suspend all manner of objects from the exterior and interior faces of building block walls. The female dovetail slots at known transverse spacings provide numerous locations for secure attachment to the walls. Walls may be constructed in very uniform length and height dimensions with relatively little skill, as the building blocks are tied together with dovetail clips rather than mortar.

Figure 6:
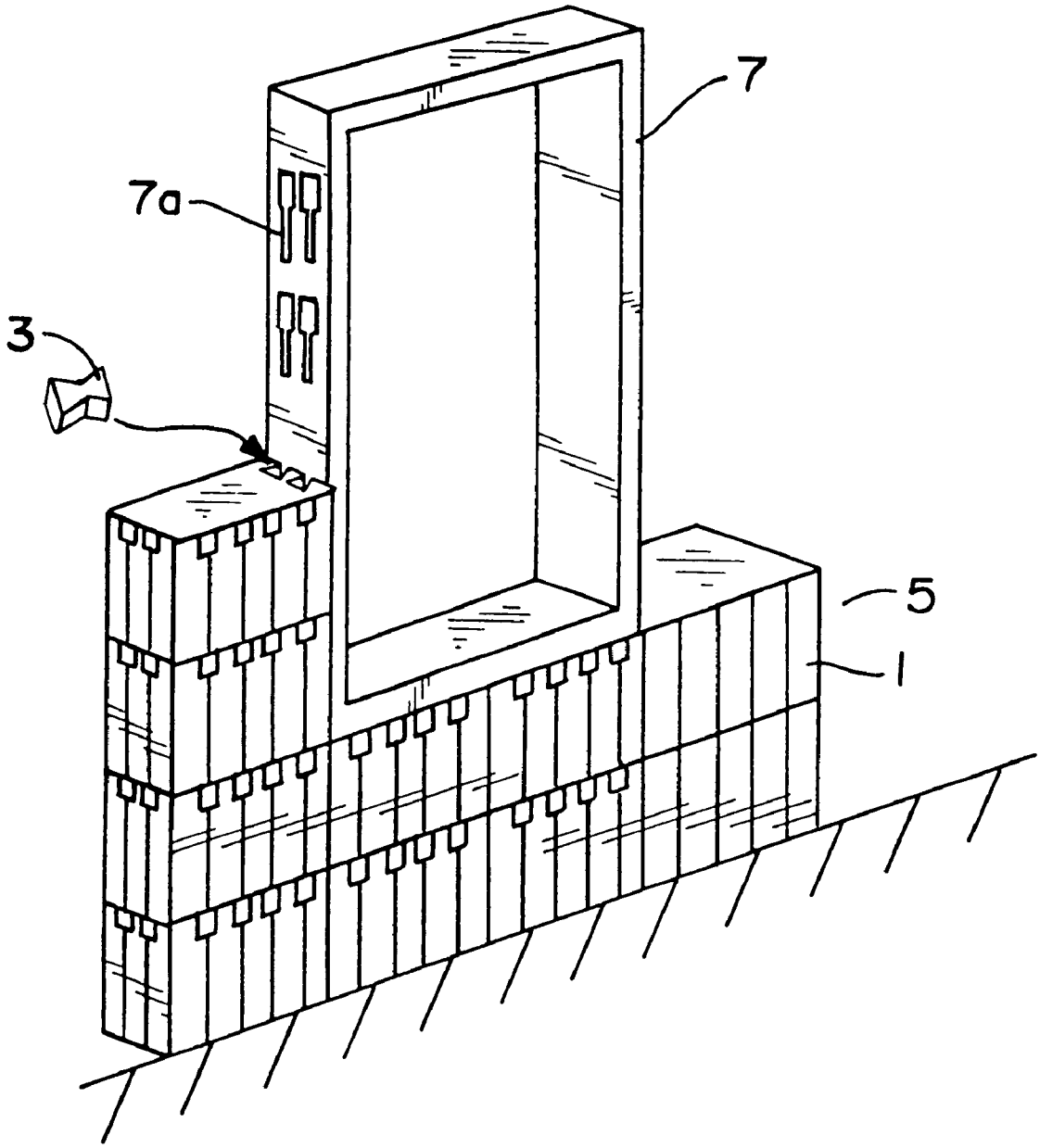
FIG. 6 is a schematic of a framing as constructed in a building block wall, said framing suitable for a window or door.

FIG. 6 shows a framing 7 as incorporated into the construction of wall 5 using building blocks of the present invention. Framing 7 may comprise the frame for a door or window. Framing 7, in the preferred embodiment, comprises a plurality of female dovetail slots 7*a*. As wall 5 is constructed, framing 7 is placed in a desired position on a row of building blocks 1. It is understood that certain details are omitted from FIG. 6 for clarity. Preferably, the dimensions of framing 7 are a multiple of the building block length, such that framing 7 occupies the length of an even multiple of building blocks.

As the succeeding rows of building blocks 1 are laid down, building blocks 1 and framing 7 are connected by clips 3 installed in aligned female dovetail slots 2 in the building blocks and the framing, as shown in FIG. 6.

The apparatus of the present invention further comprises wall studs having female dovetail slots therein, as in FIGS. 7(*a*) and 7(*b*). Wall stud 8 is preferably made of durable, decay-resistant material such as metal, high strength plastic, or reinforced concrete. A plurality of female dovetail slots 8*a* provide a means for attaching wall hangings 9 to wall studs 8, by clips 3 attached to wall hanging 9, as shown in FIG. 7(*b*).

FIGS. 8(*a*) and 8(*b*) illustrate the installation of ceiling joists 10 and roof rafters 11 using the building blocks and clips of the present invention. When wall 5 is constructed to a desired height, ceiling joist 10 may be connected to wall 5 by clips 3 affixed to ceiling joist 10 and inserted into female dovetail slots 2, as shown in FIGS. 8(*a*) and 8(*b*). In such manner, walls 5 are tied together so that no movement away from one another is possible, making a strong, rigid unit. It is understood that certain details are omitted from FIGS. 8(*a*) and 8(*b*) for clarity. In similar manner, roof rafters 11 may be mounted on walls 5 at desired spacings along wall 5. Also, the present invention provides a means for forming solid ceilings or floors of multi-story structures. To do so, tiles (not shown) may be attached to ceiling joists to span the distance between joists, and to provide a surface for pouring concrete to a desired depth (by way of example, one to four inches thick), thus forming a solid, strong ceiling or floor for the adjoining story of a multi-story building.

Yet another embodiment of the present invention comprises connecting a series of "paving stones" 12 with the clip of the present invention, each of said paving stones 12 having slots about its periphery as appropriate for insertion of the clips. FIG. 9 shows an arrangement to form a surface using paving stones 12, being another embodiment of the building block of the present invention, and the clip of the present invention. Such paving stones 12 typically are one to three inches thick, with the areal size of paving stones 12 as appropriate for the given application. It is understood that while FIG. 9 shows generally rectangular paving stones 12, the shape may be square, rectangular, octagonal, or any other desired shape. Thus connected atop an earthen surface, paving stones 12 form a firm surface for foot and vehicular traffic.

It is seen that the present invention provides a system of building construction in which building walls are constructed from building blocks without the necessity of mortar connecting the building blocks. Interior walls may comprise wall studs having female dovetail slots therein. Wall hangings, which may comprise exterior installations of brick facings, or interior installations of sheetrock, cabinetry, tile, or other similar materials.

In similar fashion to the construction of building walls as described herein, the building blocks and clips of the present invention may also be used to construct many varied structures. By way of example, the apparatus and method may be used to outdoor fabricate free-standing walls, such as for athletic courts and the like. Structures such as bridges may be fabricated using the building blocks and clips of the present invention. Various structures complementary to the construction of residential and commercial buildings may be built, such as walkways, retaining walls for gardens, and the like. Essentially, any structure which may be formed from building blocks may be advantageously constructed using the apparatus and method of the present invention.

Although the preferred embodiment of the invention has been illustrated and described herein, it is understood by those skilled in the art that various modifications may be made thereto without departing from the spirit and intent of the invention, the scope of which is to be limited only by the appended claims and their equivalents.

I claim:

1. A method of building construction, comprising the steps of:

(a) arranging a plurality of substantially uniformly dimensioned building blocks to form a plurality of walls, said building blocks connected to one another by clips disposed in mating slots in the faces of abutting building blocks, said building blocks arranged so as to provide openings in said walls for placement of windows and doors therein, each of said building blocks comprising:

top and bottom surfaces;

(ii) an interior face, an exterior face, and two end faces, said top and bottom surfaces and said interior, exterior, and end faces defining a length, a height, and a width of said building block; and (iii) at least one vertically disposed slot in each of said end faces and said interior face, said at least one slot transversing at least part of said height of said block, said at least one slot having two sides, a base, and an opening at said face of said block, a first portion of said at least one slot having a substantially constant width from said opening to said base, a second portion of said at least one slot having an opening with a width smaller than a width of said opening in said first portion, and a base with a width greater than a width of said opening of said second portion:

(iv) at least one vertical cavity;

and wherein said top and bottom surfaces are sufficiently smooth to form a seal sufficient to substantially retain a cement slurry within said at least one cavity when at least two of said blocks are vertically stacked and said cement slurry is placed in vertically aligned cavities of vertically adjacent blocks, and said slot traverses only part of said height of said block and terminates above said bottom surface of said block, thereby forming a stop to passage of a clip through said slot;

(b) providing a plurality of ceiling joists having clips connected thereto, and connecting said walls by inserting said clips connected to said ceiling joists in said slots in said faces of said building blocks in said walls; and (c) forming supported openings in said walls by disposing within said openings generally rectangular framing members, said framing members having longitudinal slots therein, and connecting said framing members to said building blocks outlining said openings by clips engaging said longitudinal slots in said framing members and said slots in said building blocks outlining said openings.

* * * * *